US006523296B1

(12) United States Patent
Constant et al.

(10) Patent No.: US 6,523,296 B1
(45) Date of Patent: Feb. 25, 2003

(54) BACKSTRAP ASSEMBLY FOR AN ELECTRONIC FIREARM

(75) Inventors: Robert L. Constant, Westfield, MA (US); John F. Klebes, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/059,904

(22) Filed: Jan. 29, 2002

(51) Int. Cl.[7] ..... F41A 19/00
(52) U.S. Cl. ..... 42/84
(58) Field of Search ..... 42/84, 70.01, 70.11; 89/28.05, 135

(56) References Cited

U.S. PATENT DOCUMENTS 4,586,282 A * 5/1986 Sniezak ..... 42/71.02
4,996,787 A * 3/1991 Holcomb et al. ..... 42/106
5,437,118 A * 8/1995 Sniezak et al. ..... 42/7
6,286,241 B1 * 9/2001 Constant et al. ..... 42/84
6,286,242 B1 * 9/2001 Klebes ..... 42/70.01
6,321,478 B1 * 11/2001 Klebes ..... 42/70.11
6,345,461 B1 * 2/2002 Constant et al. ..... 42/70.11
6,345,462 B1 * 2/2002 Mikuta et al. ..... 42/65
6,354,033 B1 * 3/2002 Findley ..... 42/70.01
6,357,157 B1 * 3/2002 Constant et al. ..... 42/65
6,360,468 B1 * 3/2002 Constant et al. ..... 42/65
6,360,469 B1 * 3/2002 Mikuta et al. ..... 42/70.11
6,360,470 B1 * 3/2002 Constant et al. ..... 42/84
6,370,806 B1 * 4/2002 Klebes et al. ..... 42/7
6,397,508 B1 * 6/2002 Constant et al. ..... 42/69.01
6,405,473 B1 * 6/2002 Petig et al. ..... 42/69.02
6,421,944 B1 * 7/2002 Klebes et al. ..... 42/70.11
6,425,199 B1 * 7/2002 Vaid et al. ..... 42/69.01
6,430,860 B1 * 8/2002 Constant et al. ..... 42/84
6,434,875 B1 * 8/2002 Constant et al. ..... 42/70.11

* cited by examiner

*Primary Examiner*—Michael J. Carone
*Assistant Examiner*—Troy Chambers
(74) *Attorney, Agent, or Firm*—McCormick, Paulding & Huber LLP

(57) ABSTRACT

A backstrap assembly for a firearm includes a backstrap housing for accommodating electronic circuitry. The backstrap housing defines a rearward gripping portion and an open-ended frontward portion. The gripping portion defines apertures for receiving therein switch activators such as push buttons or keypads. A circuit assembly is disposed within the backstrap housing, and includes electrical switches including switch activators within respective apertures of the backstrap housing. A retaining element is coupled to the backstrap housing for holding in position at a rearward end the plurality of switch activators. Preferably, the retaining element includes sidewalls having a plurality of projections received within respective openings defined by at least one opposing wall of the backstrap housings Further, the rearward gripping portion of the backstrap housing defines a plurality of ribs between the plurality of apertures for an improved gripping surface and to prevent pull-out of the switch activators.

12 Claims, 6 Drawing Sheets

BACKSTRAP ASSEMBLY FOR AN ELECTRONIC FIREARM

CROSS REFERENCE TO RELATED APPLICATIONS

Some related material is disclosed and claimed in the following U.S. Pat. No. 6,286,241, issued Sep. 11, 2001, entitled: "FIRING CONTROL SYSTEM FOR NON-IMPACT FIRED AMMUNITION"; U.S. patent application Ser. No. 09/206,013, filed Dec. 4, 1998, entitled: "FIREARM HAVING AN INTELLIGENT CONTROLLER"; U.S. patent application Ser. No. 09/629,745, filed Jul. 31, 2000, entitled: "A SECURITY APPARATUS FOR USE IN A FIREARM"; U.S. patent application Ser. No. 09/642,753, filed Aug. 21, 2000, entitled: "AN ELECTRONIC FIRING PROBE FOR DETONATING ELECTRICALLY-FIRED AMMUNITION IN A FIREARM"; U.S. patent application Ser. No. 09/642,269, filed Aug. 18, 2000, entitled: "A SLIDE ASSEMBLY FOR A FIREARM"; U.S. patent application Ser. No. 09/629,531, filed Jul. 31, 2000, entitled: "A TRIGGER ASSEMBLY FOR USE IN A FIREARM HAVING A SECURITY APPARATUS"; U.S. patent application Ser. No. 09/629,532, filed Jul. 31, 2000, entitled: "A BACKSTRAP MODULE CONFIGURED TO RECEIVE COMPONENTS AND CIRCUITRY OF A FIREARM CAPABLE OF FIRING NON-IMPACT FIRED AMMUNITION"; U.S. patent application Ser. No. 09/643,024, filed Aug. 21, 2000, entitled: "A METHOD OF ASSEMBLING A FIREARM HAVING A SECURITY APPARATUS"; U.S. patent application Ser. No. 09/629,534, filed Jul. 31, 2000, entitled: "AN AMMUNITION MAGAZINE FOR USE IN A FIREARM ADAPTED FOR FIRING NON-IMPACT DETONATED CARTRIDGES"; U.S. patent application Ser. No. 09/616,722, filed Jul. 14, 2000, entitled: "AN ELECTRONICALLY FIRED REVOLVER UTILIZING PERCUSSIVELY ACTUATED CARTRIDGES"; U.S. patent application Ser. No. 09/616,696, filed Jul. 14, 2000, entitled: "AN ELECTRONIC SIGHT ASSEMBLY FOR USE WITH A FIREARM"; U.S. patent application Ser. No. 09/616,709, filed Jul. 14, 2000, entitled: "A FIRING MECHANISM FOR USE IN A FIREARM HAVING AN ELECTRONIC FIRING PROBE FOR DISCHARGING NON-IMPACT FIRED AMMUNITION"; U.S. patent application Ser. No. 09/616,739, filed Jul. 14, 2000, entitled: "A FIRING PROBE FOR USE IN A NON-IMPACT FIREARM"; U.S. patent application Ser. No. 09/616,837, filed Jul. 14, 2000, entitled: "A SECURITY APPARATUS FOR AUTHORIZING USE OF A NON-IMPACT FIREARM"; and U.S. patent application Ser. No. 09/616,697, filed Jul. 14, 2000, entitled: "BACKSTRAP MODULE FOR A FIREARM", the disclosures of which are herein incorporated by reference.

FIELD OF THE INVENTION

This invention relates generally to a firearm, and more particularly to a backstrap assembly for an electronic firearm.

BACKGROUND OF THE INVENTION

Firearms have been produced for centuries and, although many components in their firing mechanism have remained relatively unchanged in function and design, continuous efforts have led to improvements in safety, manufacturing and operation of firearms. In recent decades, the evolution of improved electronics technology and capabilities has prompted efforts to incorporate electronics into firearms to further improve cost, manufacturability and performance of the firearms.

It is a general object of the present invention to provide a simplified safety apparatus configuration for an electronic firearm.

SUMMARY OF THE INVENTION

In accordance with the present invention a backstrap assembly for a firearm includes a backstrap housing, preferably of one piece, for accommodating electronic circuitry. The backstrap housing defines a rearward gripping portion and an open-ended frontward portion. The gripping portion defines a plurality of apertures for receiving therein switch activators such as, for example, push buttons or keypads. A circuit assembly is disposed within the backstrap housing, and includes a plurality of electrical switches including switch activators within respective apertures of the backstrap housing. A retaining element is coupled to the backstrap housing, and generally defines a frame for holding in position at a rearward end the plurality of switch activators. Preferably, the retaining element includes sidewalls having a plurality of projections received within respective openings defined by at least one opposing wall of the backstrap housing. Further, the rearward gripping portion of the backstrap housing defines a plurality of ribs between the plurality of apertures for an improved gripping surface and to prevent pull-out of the switch activators.

In an exemplary embodiment, an upper portion of the backstrap housing is open-ended and defines a compartment for accommodating additional electronic circuitry, and the backstrap assembly further includes a backstrap cover disposed over the upper portion of the backstrap housing. It is desirable that the compartment accommodates an electronic indicator, and that the backstrap cover defines at a rearward portion an opening for displaying the electronic indicator such as, for example, an LCD display. Preferably, a transparent electronic indicator cover is molded into the backstrap cover and disposed over the opening of the backstrap cover.

An advantage of the present invention is that the retaining element facilitates ease of assembly and supports the switch activators.

A second advantage of the present invention is that the backstrap cover facilitates assembly of the electronic indicator, contact switch and upper circuit board assembly.

A third advantage of the present invention is that the ribs on the backstrap housing provides an improved gripping surface and prevents pull-out of the switch activators.

A fourth advantage of the present invention is that the transparent cover for the electronic indicator is molded into the backstrap cover to provide a one piece sealed part that facilitates assembly.

A fifth advantage of the present invention is that the backstrap yoke provides an improved means for locking the backstrap cover to the backstrap housing.

These and other advantages of the present invention will become more apparent in the light of the following detailed description and accompanying figures.

DETAILED DESCRIPTION OF THE PREFERRED EMBODIMENT

Figure 1:
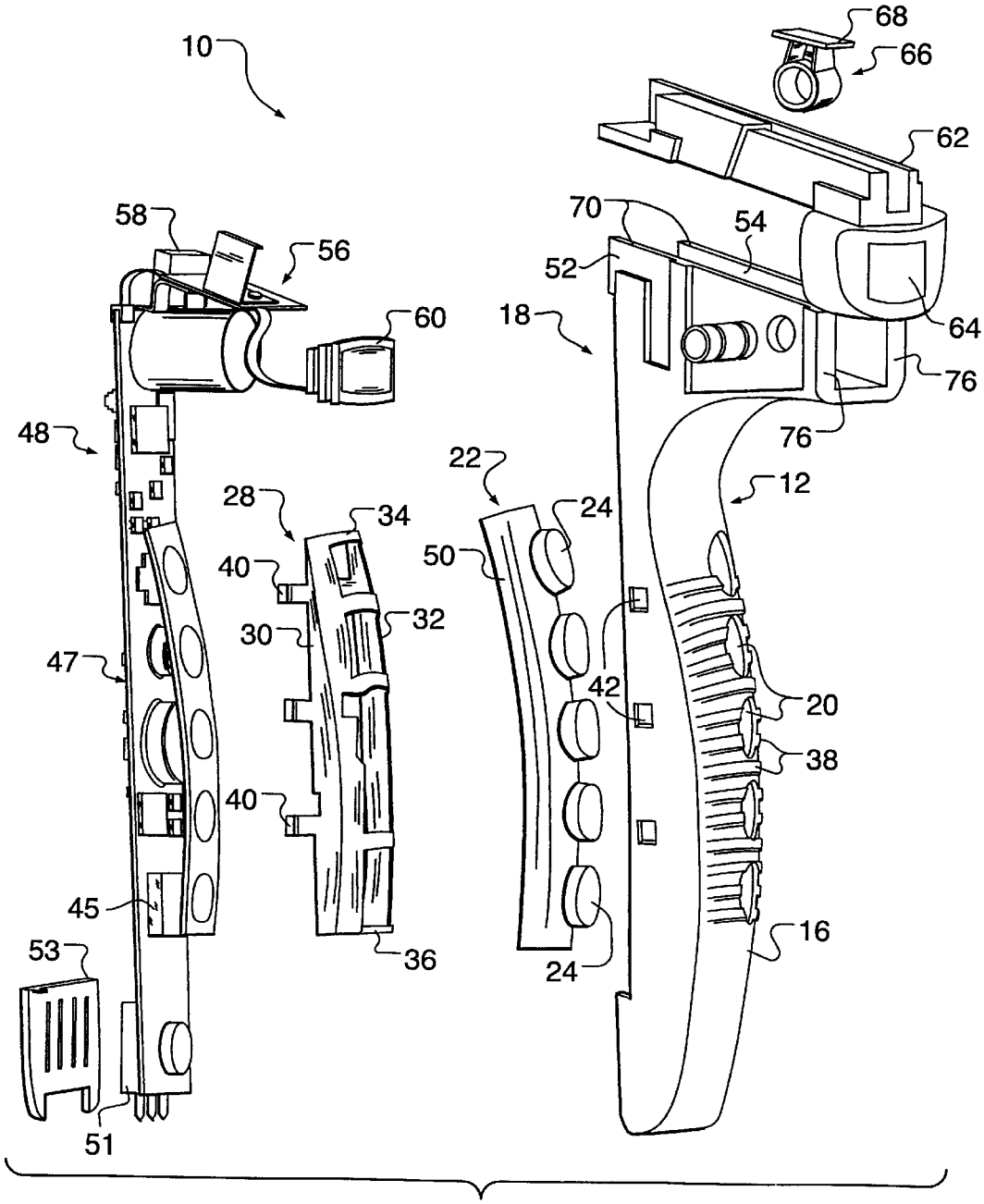
FIG. 1 is an exploded front perspective view of a backstrap assembly for use with a firearm in accordance with the present invention.

Referring to FIGS. 1–6, a backstrap assembly or security apparatus for use with a firearm in accordance with the present invention is generally designated by the reference number 10. The backstrap assembly is generally provided for authorizing the firearm to produce the firing signal. Before the backstrap assembly 10 authorizes the firearm to produce the firing signal, a plurality of input signals must be received by the backstrap assembly which are indicative of compliance with operational parameters of the firearm. The operational parameters may include, but are not limited to, a properly entered personal identification number of an authorized firearm operator, a signal indicating that the firearm is being held properly, a signal from the firing mechanism indicating its movement toward its firing position, and a signal of the firing probe contacting a properly-loaded ammunition cartridge.

The backstrap assembly includes a generally elongated backstrap housing 12, preferably of one piece, and defining a cavity 14 for accommodating electronic circuitry and components generally for controlling the discharge of the firearm. The backstrap housing 12 has a rearward gripping portion 16 and an open-ended frontward portion 18 to be covered by a finger grip attachment (not shown). The rearward gripping portion 16 defines a plurality of apertures 20 for receiving therein a plurality of electrical switch activators.

A flexible switch activator strip 22 including a plurality of electrical switch activators 24 such as, but not limited to, switch buttons or keypads spaced therealong, is received by and disposed within the cavity 14 of the backstrap housing 12 such that the switch activators 24 are aligned with and accessible by means of respective apertures 20 defined by the rearward gripping portion 16 of the backstrap housing. A retaining element 28 such as, but not limited to, a generally rigid frame-shaped bracket has a first sidewall 30, a second sidewall 32, a top wall 34 and a bottom wall 36. As shown in FIG. 1, preferably the rearward gripping portion 16 defines a plurality of ribs 38 between the apertures 20 for providing an improved gripping surface and for preventing or minimizing pull-out of the switch activator strip 22. The first and second sidewalls 30, 32 define a plurality of sidewardly extending projections 40, 40, such as, but not limited to, tabs which are lockingly engaged with respective openings 42, 42 defined by at least one opposing wall (such as first and second sidewalls 44, 46) of the backstrap housing 12. The switch activator strip 22 is generally enclosed between and thereby secured in position within the cavity 14 of the backstrap housing 12 by the first and second sidewalls 30, 32 and top and bottom walls 34, 36 of the retaining element 28.

A circuit assembly 48, including a circuit board 45 and electrical and/or electronic components mounted thereon, electrically communicates with the switch activators 24 and is received by and disposed within the cavity 14 of the backstrap housing 12. Preferably, a central longitudinal portion 47 of the circuit assembly 48 is interposed between the first and second sidewalls 30, 32 of the retaining element 28 to thereby properly position and align the circuit assembly within the cavity 14 of the backstrap housing 12. The switch activators 24 may initiate control signals to the circuit assembly 48 for performing predetermined operations such as, for example, power up the electronic firearm from a sleep mode, identify an authorized user through identification information entered through the switch activators or keypad 24, enroll user as an authorized operator, and power down firearm, but are not limited in this regard as other control and command signals may be initiated by the switch activators and performed by the circuit assembly without departing from the scope of the present invention.

In a preferred embodiment, the switch activator strip 22 has a support portion 50 for the switch activators 24 that is slightly longitudinally bowed and fabricated from a flexible and resilient material such as, but not limited to silicone rubber or plastic. Also preferably, the circuit assembly 48 includes a switch contact strip 49 that is also slightly longitudinally bowed and fabricated from a flexible material and is disposed within the cavity 14 so as to oppose the support portion 50 of the switch activator strip 22 such that pressing a switch activator 24 causes the portion of the switch activator strip in the vicinity of the pushed switch activator to flex inwardly into contact with the opposing portion of the switch contact strip which, in turn, causes the opposing portion of the switch contact strip to close an electrical switch in the circuit assembly and thereby generate an input control signal. The generally rigid retaining element 28 maintains the shape of the flexible switch activator strip 22 along its length while being flexed inwardly. A battery connector 51 receives power to the circuitry from a battery (not shown) which is externally located, such as in the magazine of a pistol firearm, and may be enclosed by a connector cover 53 for protection to the battery connector, as well as for aesthetic purposes.

Figure 3:
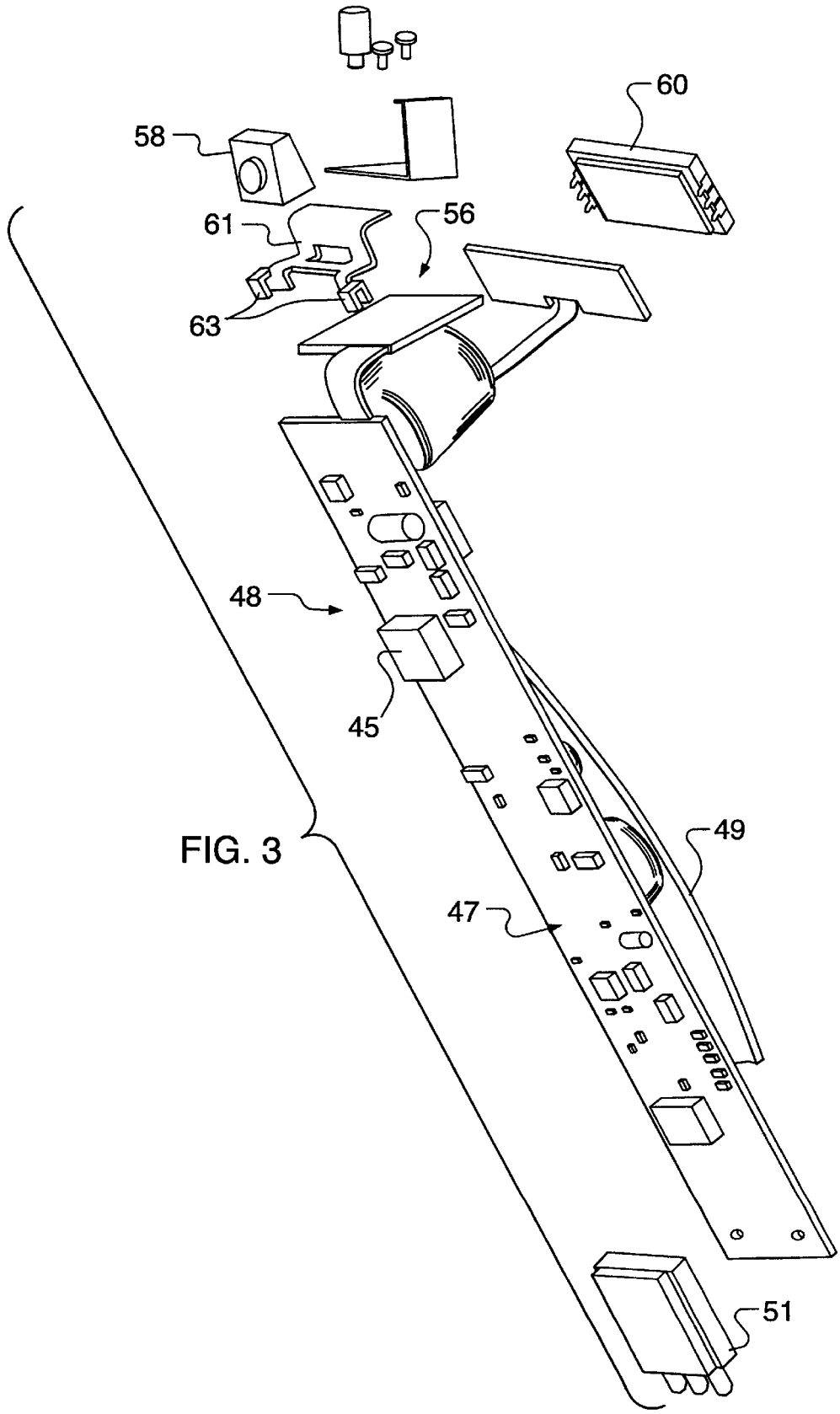
FIG. 3 is an exploded rear perspective view of the circuit assembly of the backstrap assembly.
Figure 4:
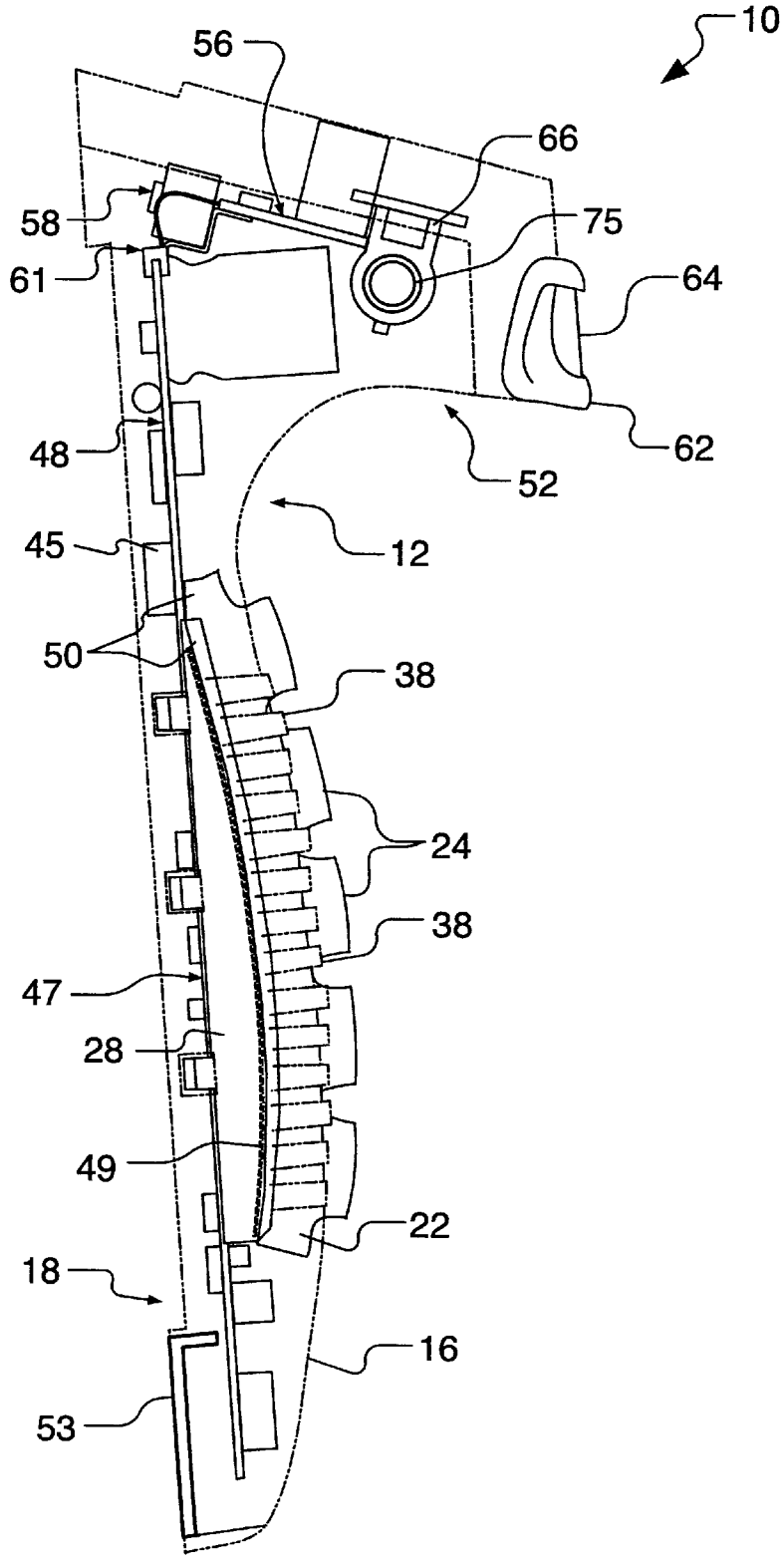
FIG. 4 is a side elevational view of the backstrap assembly of FIG. 1 in an assembled state.
Figure 5:
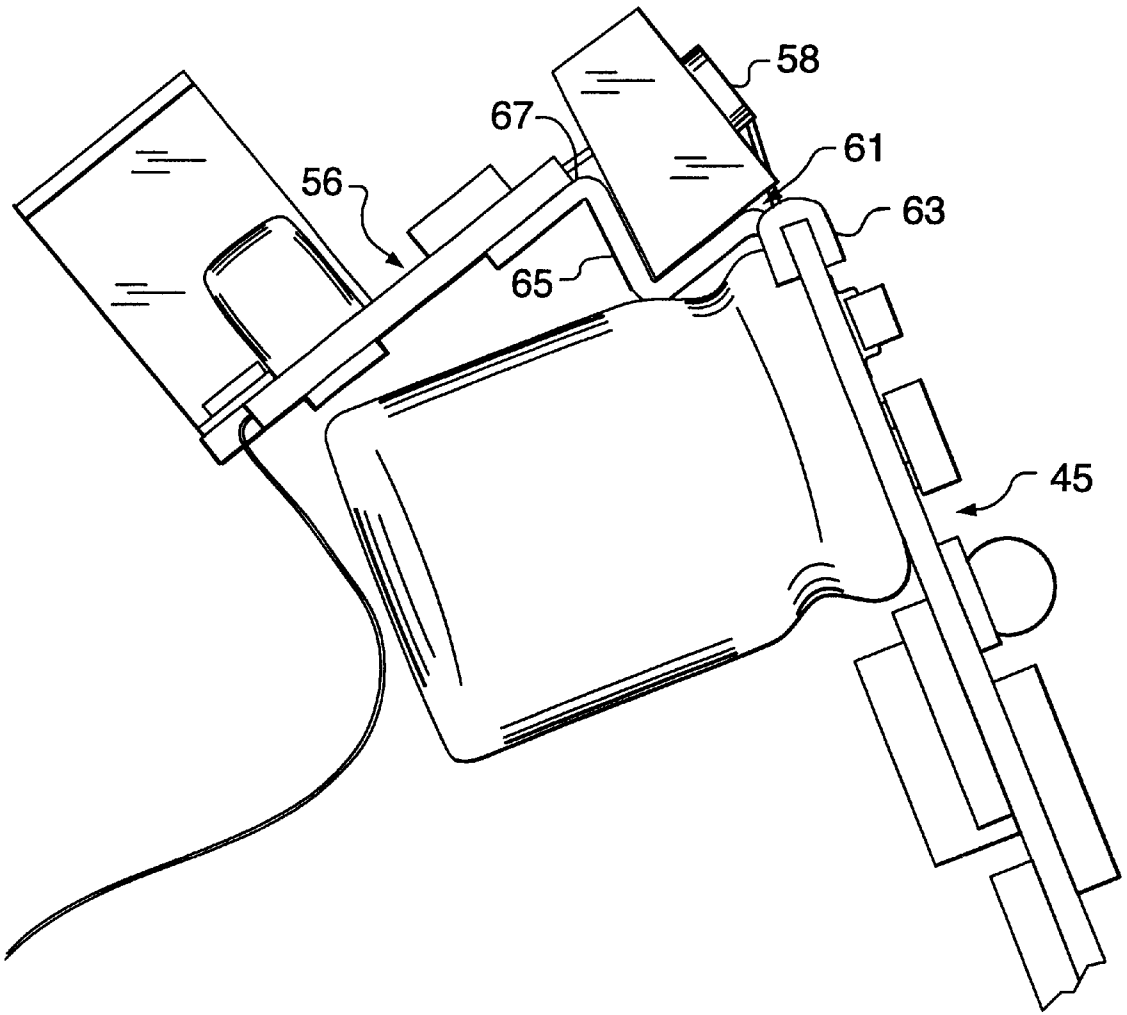
FIG. 5 is an enlarged partial view of an upper portion of the circuit board of the backstrap assembly of FIG. 1

The backstrap housing 12 preferably includes an open-ended, upper rearwardly projecting portion 52 defining a compartment 54 for accommodating additional circuitry and components. For example, the compartment 54 may accommodate an upper circuit board assembly 56 including a contact switch 58 for triggering the discharge of the firearm 10, and circuitry for an electronic indicator 60 such as an LCD display. As best shown in FIG. 3, a switch bracket 61 maintains proper relationship between the upper circuit board assembly 56 and the circuit assembly 48, and provides support for the contact switch 58. As best shown in FIGS. 3 and 5, the switch bracket 61 includes legs 63 which are received along and mounted to an upper edge of the circuit assembly 48. The switch bracket 61 generally defines a seat 65 for receiving and supporting the contact switch 58, and defines an opposite edge 67 relative to the legs 63 for supporting the upper circuit board assembly 56. The electronic indicator 60 is not limited to an LCD display as other electronic indicators such as LED displays, electronic ink displays, and other suitable electrical or electronic indicators may be substituted without departing from the scope of the present invention.

The electronic indicator 60 displays electronic information for the operator in the form of readable text and/or symbols. A plurality of signals and/or information may be programmed for display by the electronic indicator 60, including whether or not the firearm has been authorized for use or is in the condition to be fired, and whether or not the handgrip is being grasped properly by the user. Additional information which may be displayed includes, but is not limited to, the level of energy stored within the battery, and whether the firearm is fully powered on, or is in a standby mode.

Figure 2:
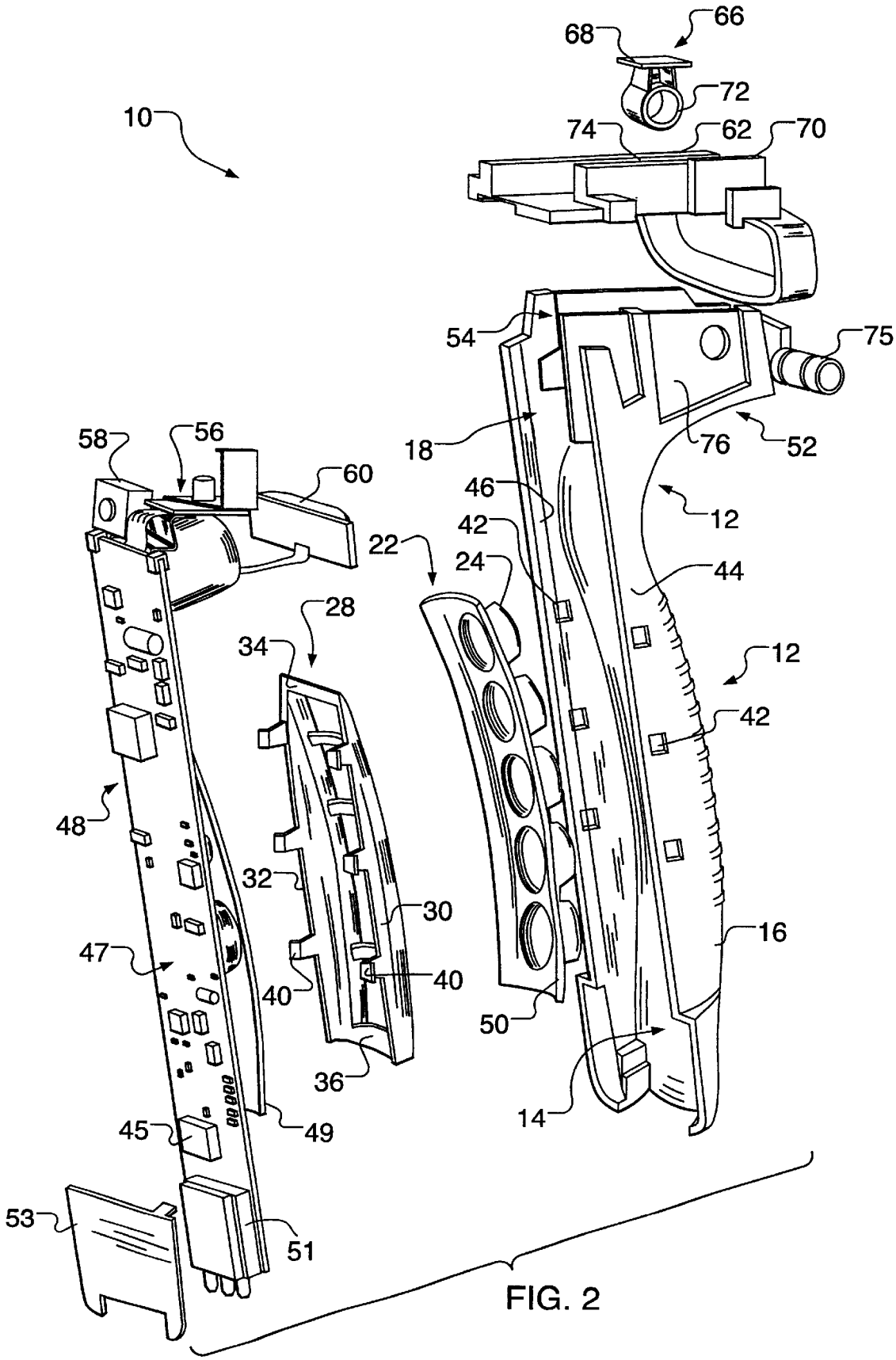
FIG. 2 is an exploded rear perspective view of the backstrap assembly of FIG. 1.
Figure 6:
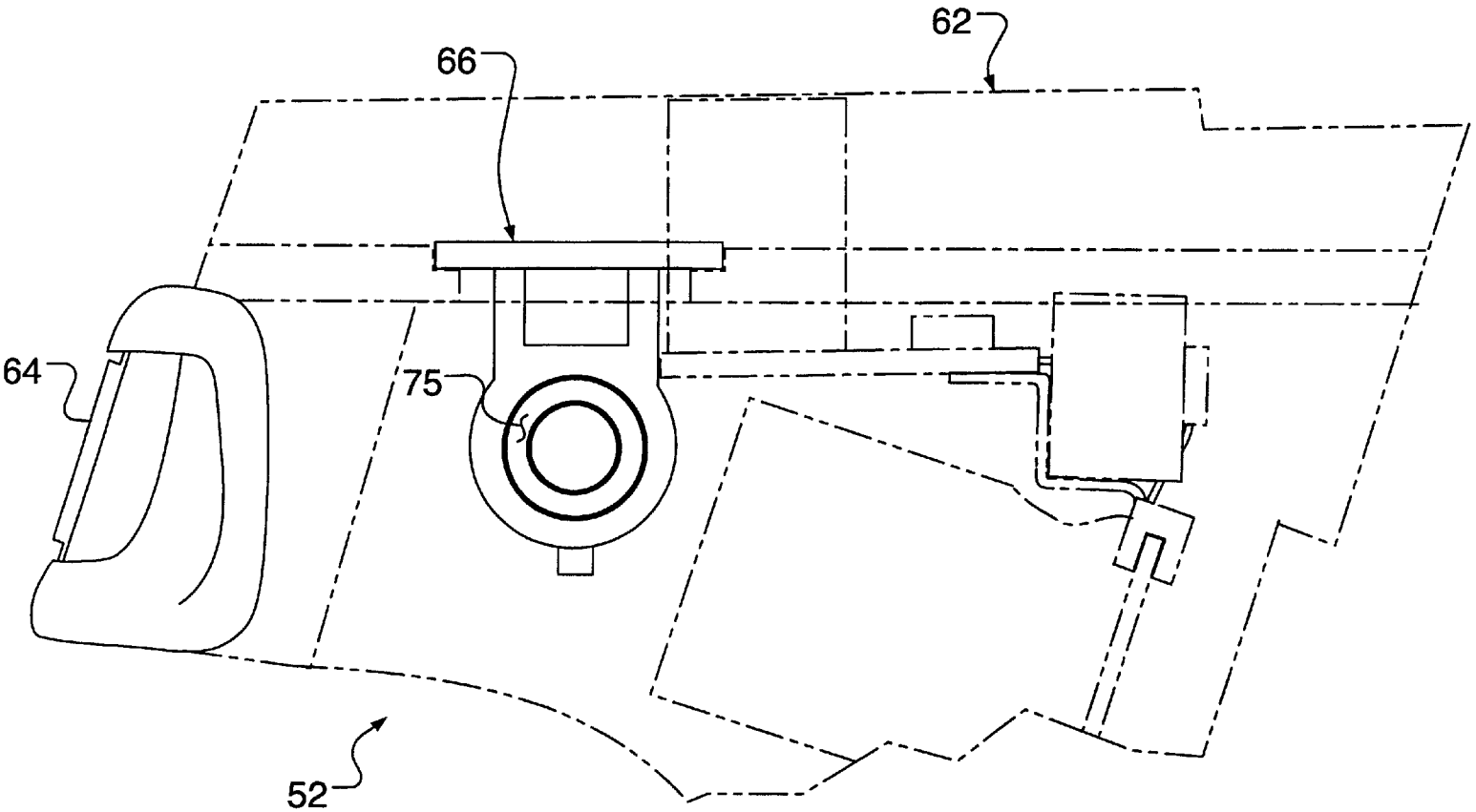
FIG. 6 is an enlarged side elevational view showing a yoke connecting the backstrap cover to the backstrap housing of the backstrap assembly of FIG. 1.

The backstrap assembly 10 may further include a backstrap cover 62 enclosing the compartment 54 defined by the open-ended, upper rearwardly projecting portion 52 of the backstrap housing 12. The backstrap cover 62 includes a transparent cover or lens 64 aligned with the electronic indicator 60 to thereby provide protection to the electronic indicator while permitting a user to easily read information displayed by the electronic indicator. Preferably, the transparent cover 64 for the electronic indicator 60 is molded into the backstrap cover 62 for providing a sealed unit and for ease of assembly. A yoke 66 is preferably used for connecting the backstrap cover 62 to the backstrap housing 12. As shown in FIGS. 1, 2 and 6, the yoke 66 includes an overhanging top surface 68 for being secured over top edges 70 of the backstrap cover 62, and includes sideward projections 72 that lockingly engage openings 74 and supported therein by surrounding rivet 75 defined by opposing sidewalls 76 of the backstrap housing 12. The yoke 66 may be substituted with other suitable connectors such as, but not limited to, pins, screws or bolts without departing from the scope of the present invention.

Although the invention has been shown and described in a preferred embodiment, it should be understood that numerous modifications can be made without departing from the spirit and scope of the present invention. Accordingly, the present invention has been shown and described by way of illustration rather than limitation.

What is claimed is:

1. A backstrap assembly for a firearm, the backstrap assembly comprising:

a backstrap housing for accommodating electronic circuitry, the backstrap housing defining a rearward gripping portion and an open-ended frontward portion, the gripping portion defining a plurality of apertures for receiving therein switch activators;

a circuit assembly disposed within the backstrap housing, the circuit assembly including a plurality of electrical switches including switch activators within respective apertures of the backstrap housing; and a retaining element coupled to the backstrap housing, the retaining element generally defining a frame for holding in position at a rearward end the plurality of switch activators.

2. A backstrap assembly as defined in claim 1, wherein the retaining element includes sidewalls having a plurality of projections received within respective openings defined by at least one opposing wall of the backstrap housing.

3. A backstrap assembly as defined in claim 2, wherein a portion of the circuit assembly is interposed between the sidewalls of the retaining element for positioning the circuit assembly within the backstrap housing.

4. A backstrap assembly as defined in claim 1, wherein the plurality of switch activators are push buttons.

5. A backstrap assembly as defined in claim 1, wherein the rearward gripping portion of the backstrap housing defines a plurality of ribs between the plurality of apertures.

6. A backstrap assembly as defined in claim 1, wherein the backstrap housing is of one piece.

7. A backstrap assembly as defined in claim 6, wherein an upper portion of the backstrap housing is open-ended and defines a compartment for accommodating additional electronic circuitry, and further including a backstrap cover disposed over the upper portion of the backstrap housing.

8. A backstrap assembly as defined in claim 7, wherein the compartment defined by the upper portion of the backstrap housing accommodates an electronic indicator, and the backstrap cover defines at a rearward portion an opening for displaying the electronic indicator.

9. A backstrap assembly as defined in claim 8, further including a cover molded into the backstrap cover and disposed over the opening of the backstrap cover.

10. A backstrap assembly as defined in claim 8, wherein the electronic indicator is an LCD display.

11. A backstrap assembly as defined in claim 7, further including means for coupling the backstrap cover to the backstrap housing.

12. A backstrap assembly as defined in claim 11, wherein the coupling means is a yoke.

* * * * *